United States Patent [19]

Garrison

[11] 4,070,128

[45] Jan. 24, 1978

[54] MULTIPLE-GROOVER FOR PAVEMENTS

[76] Inventor: Harry F. Garrison, 7470 Gerald, Warren, Mich. 48092

[21] Appl. No.: 670,187

[22] Filed: Mar. 25, 1976

[51] Int. Cl.[2] ..... E01C 23/02

[52] U.S. Cl. ..... 404/89; 404/97; 15/120 A

[58] Field of Search ..... 404/89, 93, 97; 52/749; 16/114 R; 15/120 A, 145

[56] References Cited

U.S. PATENT DOCUMENTS

| | | | |
|---|---|---|---|
| 115,040 | 5/1871 | Dunaway | 15/145 X |
| 774,005 | 11/1904 | Thies | 404/89 X |
| 1,095,873 | 5/1914 | Jayne | 15/145 |
| 1,797,366 | 3/1931 | Rackliffe | 15/145 X |
| 2,293,905 | 8/1942 | Krebs | 15/145 X |
| 2,639,454 | 5/1953 | Dory | 15/145 X |
| 2,851,710 | 9/1958 | Leach | 15/145 X |
| 3,595,143 | 7/1971 | Polselli | 404/93 |
| 3,806,268 | 4/1974 | Francis | 404/89 |
| 3,936,210 | 2/1976 | Oehlerking | 404/89 |

*Primary Examiner*—Nile C. Byers

*Attorney, Agent, or Firm*—Willis Bugbee

[57] ABSTRACT

Secured to or formed on the lower side of an elongated narrow base plate or support are multiple pavement grooving members of substantially the same configuration in comparison with one another secured thereto in laterally-spaced parallel relationship. Each grooving member is an elongated narrow body of approximately V-shaped cross-section with upturned forward and rearward ends for ease of pushing or pulling it through a pavement in a plastic state to form multiple parallel grooves therein for enhancing traction of persons or vehicles passing thereover. An approximately truncated V-shaped hollow handle receiver is secured to the upper side of the elongated plate in approximately perpendicular relationship thereto. The handle receiver thus has two outwardly-inclined arms, either or both of which receive the lower end of a handle so that one person or two persons may operate the groover by pulling it in opposite directions across or along the pavement, which may be either a roadway, a sidewalk, or the like.

1 Claim, 4 Drawing Figures

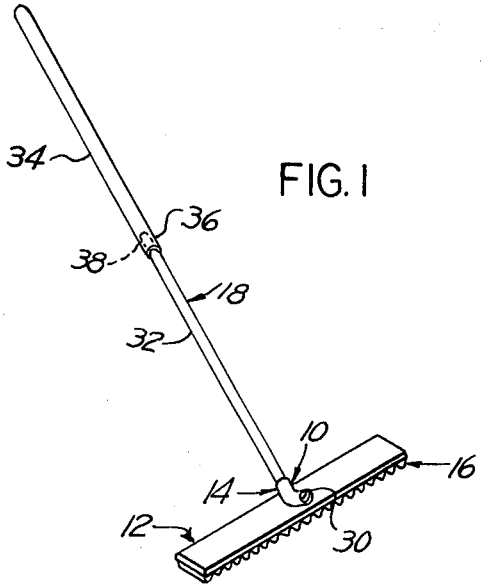
FIG. 1
FIG. 4
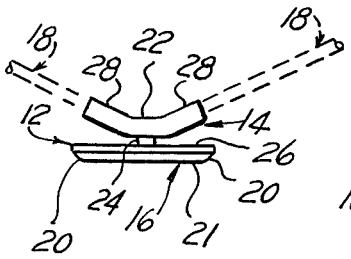
FIG. 2
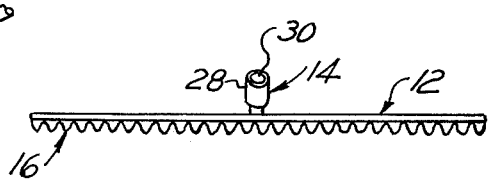
FIG. 3
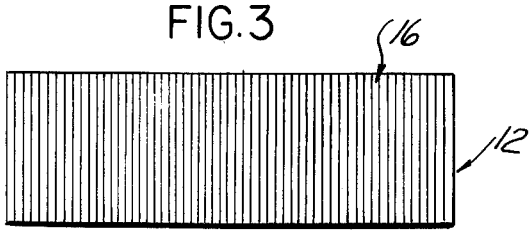

MULTIPLE-GROOVER FOR PAVEMENTS

SUMMARY OF THE INVENTION

The invention particularly resides in the multiple elongated boat-shaped grooving members of approximately V-shaped cross-section of substantially the same configuration in comparison with one another arranged side by side in spaced parallel relationship and having upturned ends. This assembly may be mounted upon the lower side of a mounting plate.

In the drawing,

FIG. 1 is a perspective view upon a reduced scale of the pavement groover, according to one form of the invention, with a single handle inserted in the handle receiver;

FIG. 2 is a front view of the pavement groover of FIG. 1, with the handle omitted;

FIG. 3 is a bottom plan view of the pavement groover shown in FIG. 2; and

FIG. 4 is a side elevation of the pavement groover shown in FIGS. 2 and 3, with the lower end portion of the two removable handles shown in dashed lines.

Referring to the drawing in detail, FIG. 1 shows, on a greatly reduced scale, a pavement groover, generally designated 10, according to one form of the invention, as comprising an elongated narrow base plate or support 12 on the upper side of which is mounted an approximately V-shaped handle receiver or handle attachment element 14 and on the lower side of the base plate 12 are formed or mounted multiple elongated boat-shaped grooving members 16 of substantially the sane configuration in comparison with one another disposed in spaced parallel relationship transverse to the plate 12 and of approximately V-shaped cross-section. The lower end of an elongated handle 18 is mounted in one end of the handle receiver 14 as described below. The base plate 12 has a length which is a plurality of times its width, and the multiple grooving members 16 are preferably formed unitarily with the plate 12, such as by a casting or extrusion procedure. The opposite ends 20 of the grooving members 16 are preferably upturned (FIG. 4) to enhance their ease of passing through the concrete, asphalt or other pavement surface while in a plastic or fluid condition.

The handle receiver 14 is preferably tubular and has a horizontal central or intermediate portion 22 which is secured as at 24 by welding or riveting or by other fastening means to the upper surface 26 of the base plate or support plate 12. Inclined upward from and integral with the central portion 22 in opposite directions are two arms 28, each provided with a socket 30 therein (FIG. 2), preferably internally-threaded to receive the correspondingly threaded lower end of the handle or handles 18. For compactness in transport and storage, each of the handles 18 is preferably made in two sections 32 and 34 respectively, with the upper section 34 telescopingly receiving the lower section 32 at a joint 36 (FIG. 1). In particular, the socket 38 in the lower end of the handle section 34 is preferably internally-threaded to receive the correspondingly threaded upper end of the lower handle section 32.

In operation by one person, the lower end of a single handle 18 is secured within the socket 30 of the handle receiver 14 and the two handle sections 32 and 34 similarly joined. The operator then grasps the upper section 34 of the handle 18 and, resting the lower side of the plate 12 with its grooving member 16 on the surface of the plastic or fluid pavement material, such as concrete or asphalt, presses downward upon the handle 18 to force the grooving members 16 downward into the paving material. He then draws the groover horizontally through the pavement material, at the same time pressing downward upon the handle 18 to maintain the grooving members 16 immersed in the fluid pavement material. While this is occurring and the grooves are being formed in the pavement by the horizontal central portions 21 of the grooving members 16, the upturned ends 20, in the direction in which he is pulling, push the pavement material to one side or the other in order to form the grooves in the pavement.

By pushing the handle 18 away from himself, the operator makes a return stroke of the groover 10 after he has transferred it to an ungrooved location, thereby executing forward and return strokes of the groover 10. If, however, a second workman is present, the second handle 18 is inserted in the opposite arm 28 of the handle receiver 14 and the two operators on opposite sides of the pavement strip execute alternate pulling strokes upon the handles 18 in alternate locations along the pavement strip.

I claim:

1. A multiple-groover for simultaneously forming uniform multiple parallel grooves in pavements, comprising:

an elongated approximately plate-shaped support having on its under side a multiplicity of elongated boat-shaped grooving members disposed in spaced parallel relationship transverse to said support, said grooving members being of approximately V-shaped cross-section with upturned forward and rearward ends and of substantially the same configuration in comparison with one another, a handle attachment element secured to the upper side of said support, and a handle secured to said attachment element, said handle being disposed at an acute angle of inclination to said support.

* * * * *